US005893804A

United States Patent [19]

Pan

[11] Patent Number: 5,893,804

[45] Date of Patent: Apr. 13, 1999

[54] GOLF CLUB STRUCTURE

[76] Inventor: Shui-Ho Pan, No. 67, Wuchuan W. 4th St., Taichung, Taiwan

[21] Appl. No.: 09/004,957

[22] Filed: Jan. 8, 1998

[51] Int. Cl.[6] ..... A63B 69/36

[52] U.S. Cl. ..... 473/240; 473/241

[58] Field of Search ..... 473/240, 241, 473/242, 219, 220, 226, 231, 243, 251, 257, 313, 324, 340, 325

[56] References Cited

U.S. PATENT DOCUMENTS

| | | | |
|---|---|---|---|
| D. 137,283 | 2/1944 | Jakosky . | |
| D. 206,540 | 12/1966 | Mackenzie | 473/243 |
| 1,334,189 | 3/1920 | Swanson | 473/306 |
| 2,919,922 | 1/1960 | Skelly | 473/241 |
| 3,085,804 | 4/1963 | Pieper | 473/325 |
| 3,242,582 | 3/1966 | Garrett | 473/226 |
| 3,682,516 | 8/1972 | Savage | 473/306 |
| 4,927,151 | 5/1990 | Ronnick | 473/241 |

*Primary Examiner*—Sebastiano Passaniti
*Attorney, Agent, or Firm*—Kolisch Hartwell Dickinson McCormack & Heuser

[57] ABSTRACT

A golf club structure includes a shaft having a first end portion and a second end portion, an alignment apparatus including a prism pivotally mounted on the first end portion of the shaft, and a first alignment line formed on the prism, and a head fixedly mounted on the second end portion of the shaft and including a top face and a bottom face, and a second alignment line formed on the top face of the head and aligning with the first alignment line.

3 Claims, 8 Drawing Sheets

GOLF CLUB STRUCTURE

FIELD OF THE INVENTION

The present invention relates to a golf club structure.

BACKGROUND OF THE INVENTION

Usually, prior to striking a ball, a golfer has to determine the most suitable trajectory of the ball by aligning the shaft of the golf club with the ball on the ground and the flagstick in the hole. However, this method is very approximate and thus does not lead to the desired accurate and consistent results.

Additionally, each of a conventional set of clubs is designed for a specific purpose and accordingly, a golfer has to carry around a great many different clubs in anticipation of meeting a special circumstance requiring use of a particular club. Such a wide range of clubs is expensive and inconvenient to carry.

In addition, the conventional golf club is formed with a head functioning as a batting head, a putter or a sand wedge only such that the golfer has to carry many golf clubs suitable for different functions, thereby greatly limiting the versatility of the golf club.

Moreover, the conventional golf club is suitable for right handed or left handed users only and cannot provide an ambi-dexterous function.

Further, the head of the conventional golf club cannot match the center of gravity of the golf ball when the ball is not disposed in a level state, e.g., when it is placed on an uneven patch of grass, thereby greatly affecting the travel direction of the golf ball when being struck.

The present invention has arisen to mitigate and/or obviate the disadvantage of the conventional golf club.

SUMMARY OF THE INVENTION

In accordance with one aspect of the present invention, there is provided a golf club structure comprising a shaft including a first end portion and a second end portion, an alignment apparatus including a prism pivotally mounted on the first end portion of the shaft, and a first alignment line formed on the prism, and a head fixedly mounted on the second end portion of the shaft and including a top face and a bottom face, and a second alignment line formed on the top face of the head and aligning with the first alignment line.

In accordance with another aspect of the present invention, there is further provided a golf club structure comprising a shaft including a first end portion and a second end portion, and a head fixedly mounted on the second end portion of the shaft and including a top face, a bottom face, at least one first side formed with a first ball-striking surface, such as a driver, and a second side formed with a second ball-striking surface, such as a sand wedge.

Further features of the present invention will become apparent after a careful reading of the detailed description with appropriate reference to the accompanying drawings.

DETAILED DESCRIPTION OF THE PREFERRED EMBODIMENTS

Figure 1:
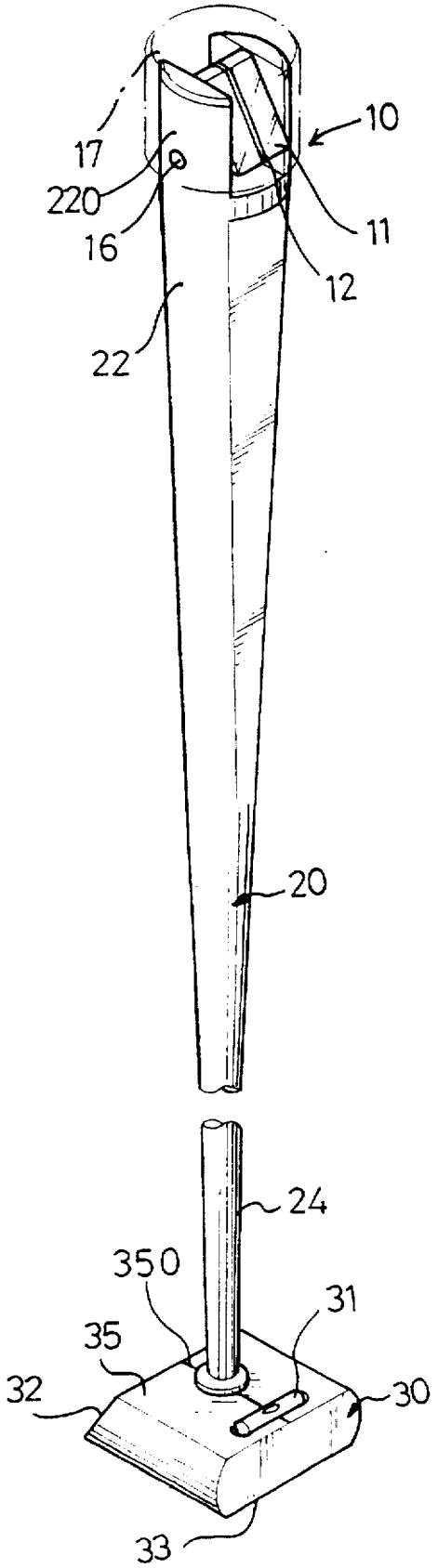
FIG. 1 is a perspective view of a golf club structure according to a first embodiment of the present invention.

Referring to the drawings, and initially to FIGS. 1–4, a golf club structure according to a first embodiment of the present invention comprises a shaft 20 including a first end portion 22 and a second end portion 24, an alignment apparatus 10 including a prism 11 pivotally mounted on the first end portion 22 of the shaft 20 and formed with a first alignment line 12, and a head 30 fixedly mounted on the second end portion 24 of the shaft 20 and including a top face 35 and a bottom face 33, a second alignment line 350 formed on the top face 35 of the head 30 and aligning with the first alignment line 12, and a spirit level 31 fixedly mounted on the top face 35 of the head 30.

The first end portion 22 of the shaft 20 has two lugs 220 define a recess 224 there between. The two lugs 220 each transversely define a hole 222 communicating with the recess 224. The prism 11 is received in the recess 224 and includes two sides each defining a depression 111 aligning with the hole 222 of a corresponding one of the two lugs 220.

The alignment apparatus 10 further comprises two retaining pins 16 each extending through the hole 222 of a corresponding one of the two lugs 220 and partially received in the depression 111 of a corresponding one of the two sides of the prism 11 such that the prism 11 can be pivoted in the recess 224.

The alignment apparatus 10 comprises a protective hood 17 removably mounted on an outer periphery of the first end portion 22 of the shaft 20 for encompassing the prism 11.

Figure 2:
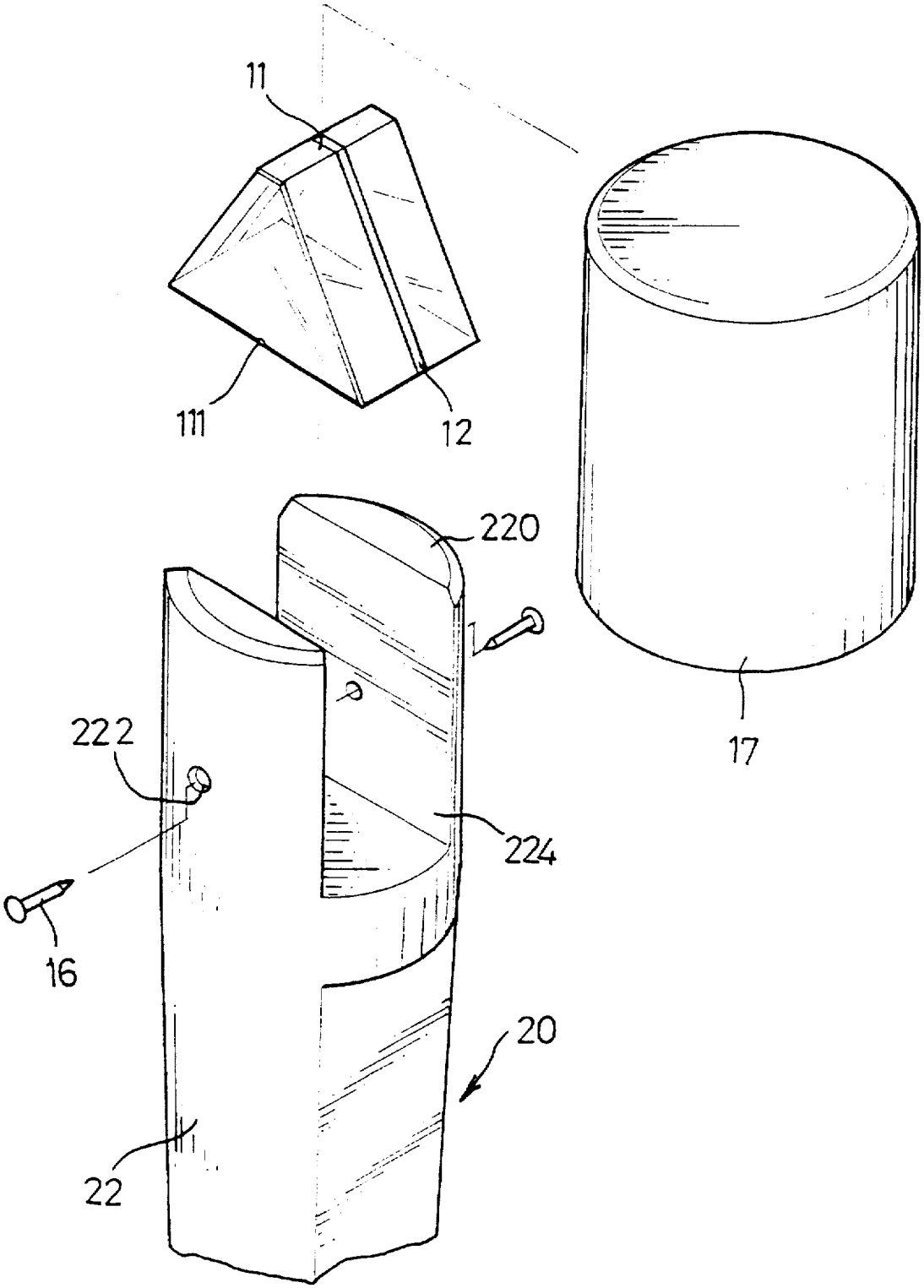
FIG. 2 is a partially cut-away exploded view of the golf club structure as shown in FIG. 1.
Figure 3:
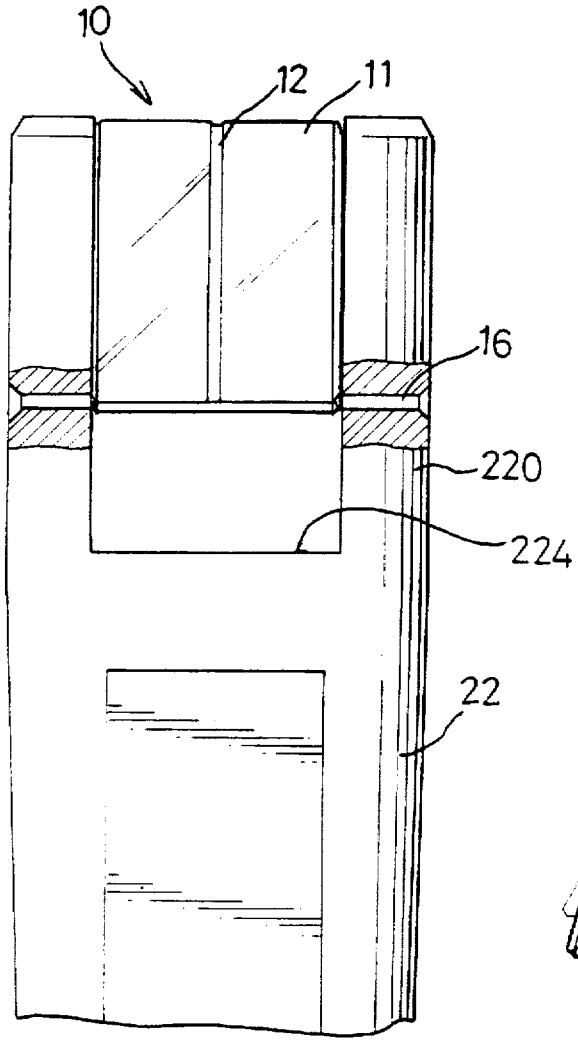
FIG. 3 is a partially side cross-sectional assembly view of the golf club structure as shown in FIG. 2 with a hood removed.
Figure 4:
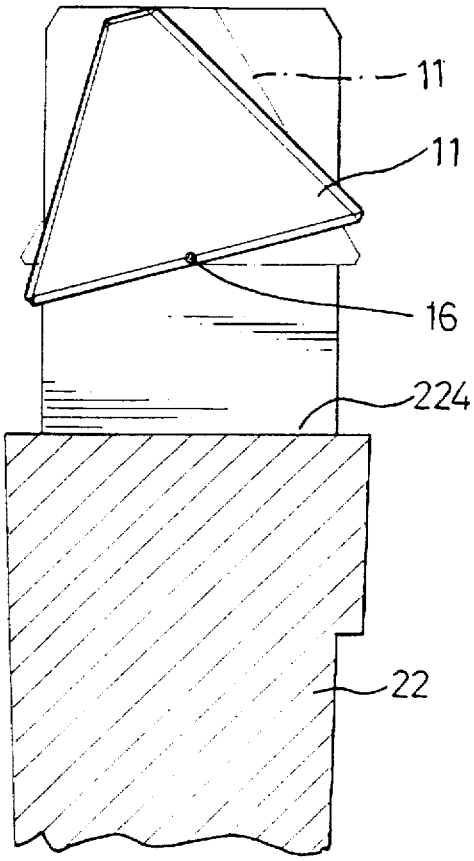
FIG. 4 is a front plan partially cross-sectional assembly view of the golf club structure as shown in FIG. 2 with the hood removed.
Figure 5:
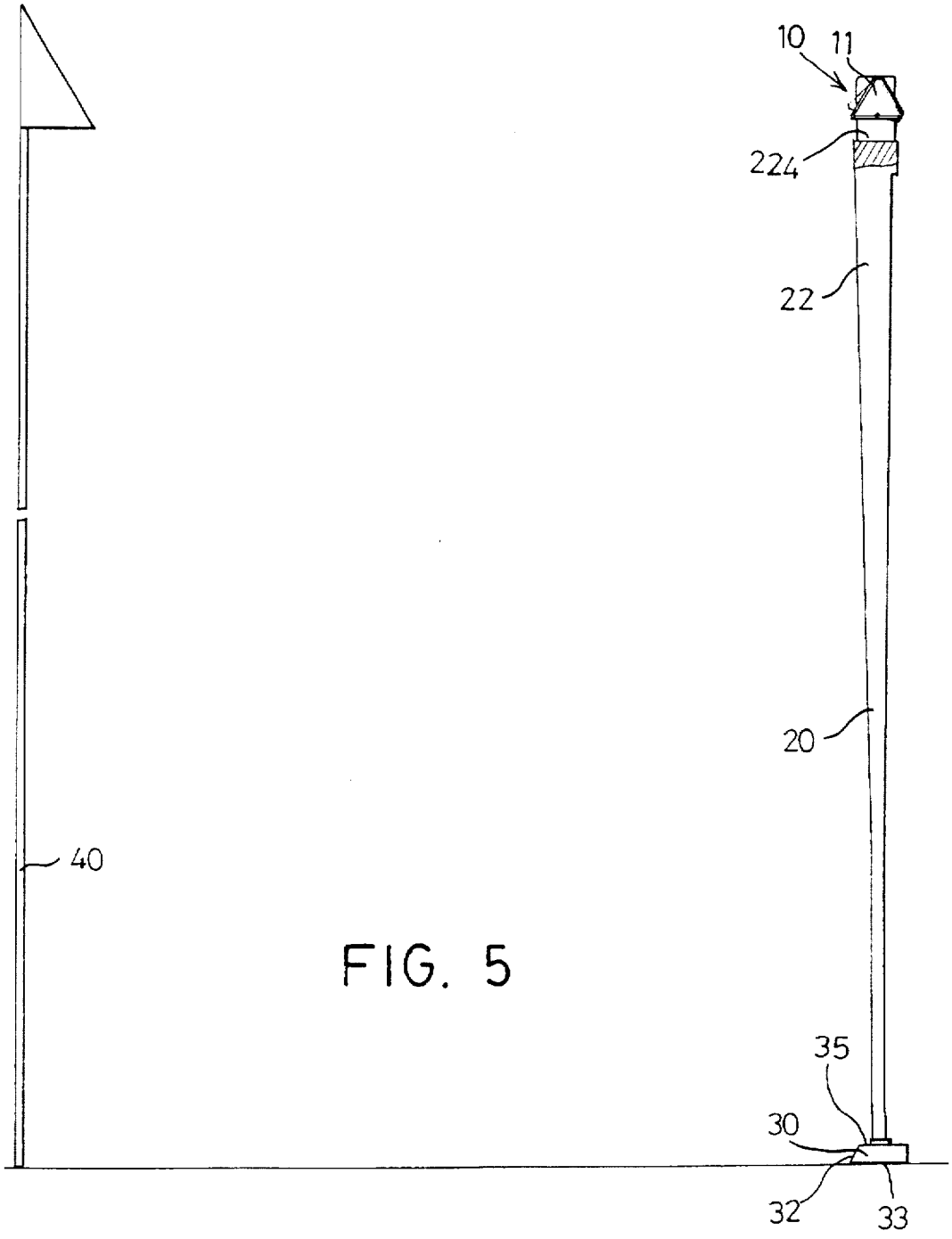
FIG. 5 is a schematic operational view of the golf club structure.
Figure 6:
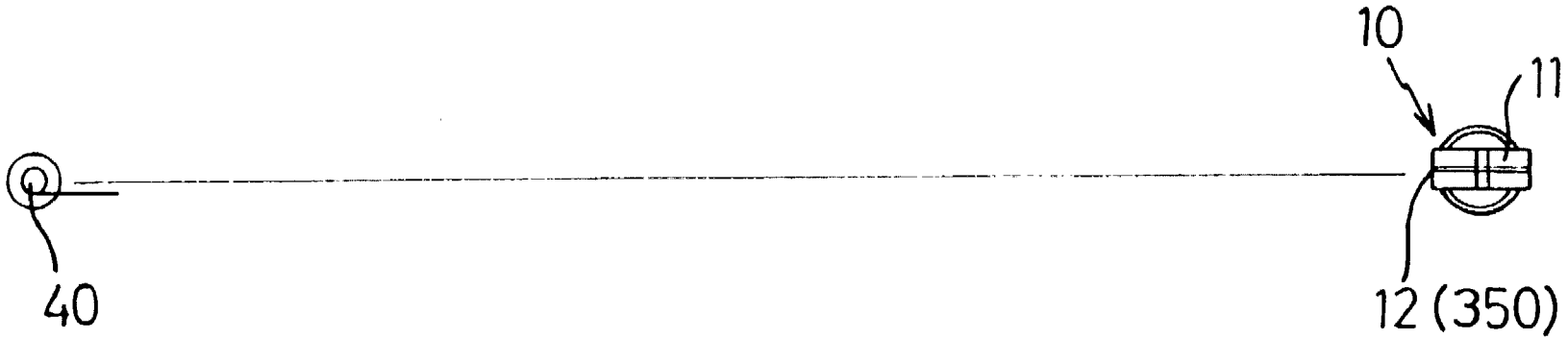
FIG. 6 is a top plan view of FIG. 5.

In operation, referring to FIGS. 5 and 6 with reference to FIGS. 1 and 2, the head 30 initially placed on the ground can be slightly turned so as to let the second alignment line 350 align with a flagstick 40 substantially.

The image of the flagstick 40 can then be shown on the prism 11 by means of pivoting the prism 11 relative to the two lugs 220 of the shaft 20. In such a situation, the image of the flagstick 40 is not in line with the first alignment line 12 which aligns with the second alignment line 350.

The prism 11 can then be turned with the two lugs 220 by means of turning the shaft 20 relative to the flagstick 40 until the image of the flagstick 40 shown on the prism 11 aligns with the first alignment line 12 such that the image of the flagstick 40 aligns with the second alignment line 350 which means that the second alignment line 350 of the head 30 is in line with the flagstick 40 exactly.

By such an arrangement, a golfer can position hem or her-self with a ball-striking surface 32 of the head 30 in front of a golf ball (not shown) to let the golf ball align with the second alignment line 350 which is exactly in line with the flagstick 40 such that the striking surface 32 of the head 30, the golf ball, and the flagstick 40 align with each other, and such that the golfer can aim at the flagstick 40 more accurately, thereby greatly increasing the precision of striking the golf ball.

Referring now to FIGS. 7–10, a golf club structure in accordance with a second embodiment of the present invention comprises a shaft 20 including a first end portion 22 and a second end portion 24, and a tetrahedral head 30 fixedly mounted on the second end portion 24 of the shaft 20 and including a top face 35, a flat bottom face 33, three first sides 32 each formed as a separate type of golf club head such as a driver, iron and a putter, and a second side 34 formed as a sand wedge.

By such an arrangement, the golf club structure can be used to drive or putt a golf ball (not shown) by means of using each of the three first sides 32 and can be used to strike the golf ball from a sand trap (not shown) by means of using the second side 34, thereby greatly enhancing the versatility of the golf club structure.

In addition, the golf club structure can be used to provide an ambi-dexterous function to be suitable for both right handed and left handed users.

Three spirit levels 31 are each fixedly mounted on the top face 35 of the head 30 and are each located adjacent to a corresponding one of the three first sides 32 of the head 30. Each of the spirit levels 31 includes an indicating bubble 310 movably mounted therein.

The top face 35 of the head 30 defines a screw hole 352 therein, and the second end portion 24 of the shaft 20 is formed with an outer thread 240 threadedly engaged in the screw hole 352.

Figure 7:
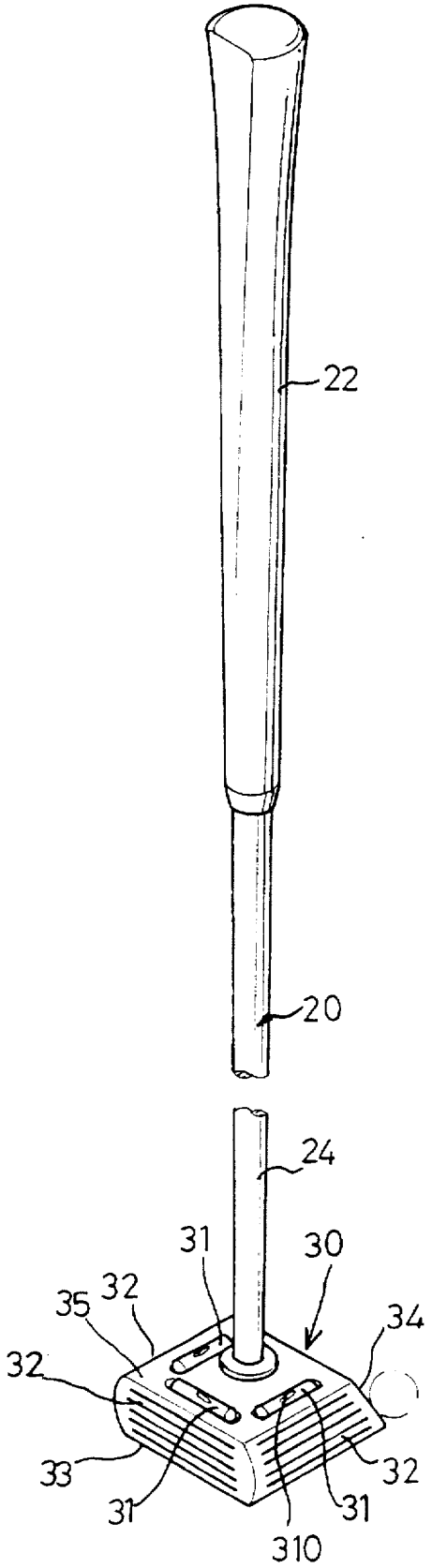
FIG. 7 is a perspective view of a golf club structure according to a second embodiment of the present invention.
Figure 8:
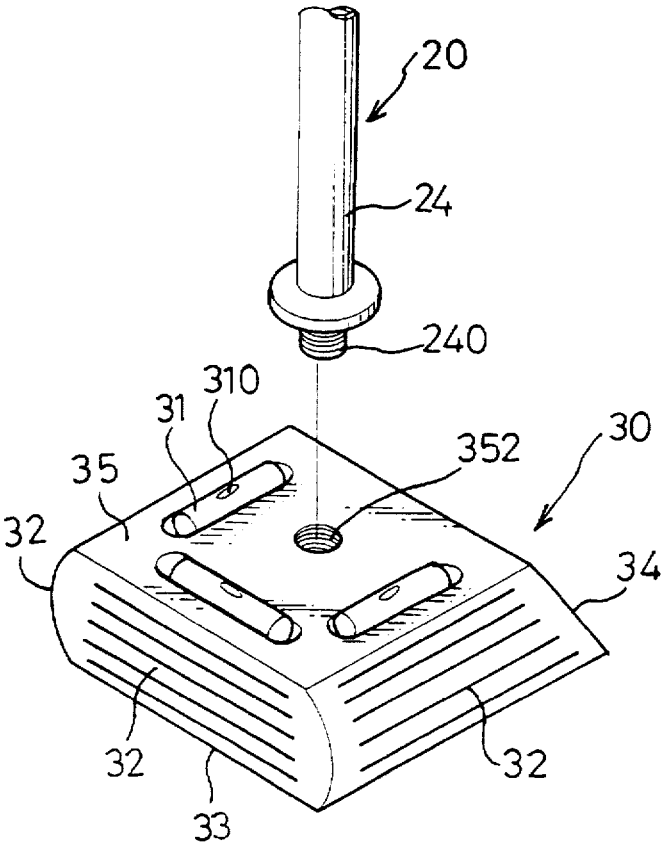
FIG. 8 is a partially cut-away exploded view of the golf club structure as shown in FIG. 7.
Figure 9:
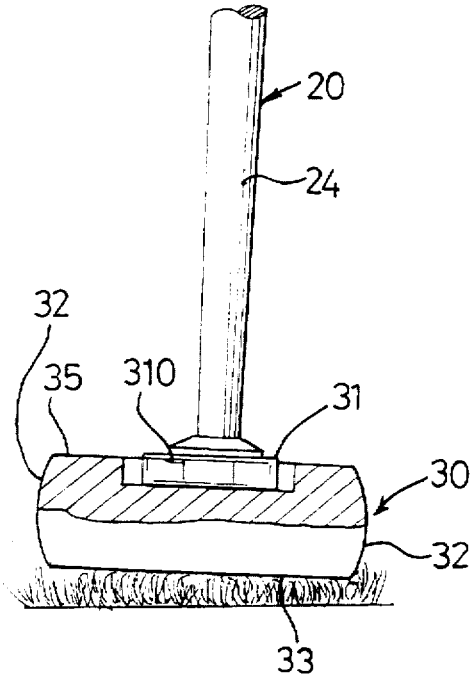
FIG. 9 is a partially cut-away front plan cross-sectional view of the golf club structure as shown in FIG. 7.
Figure 10:
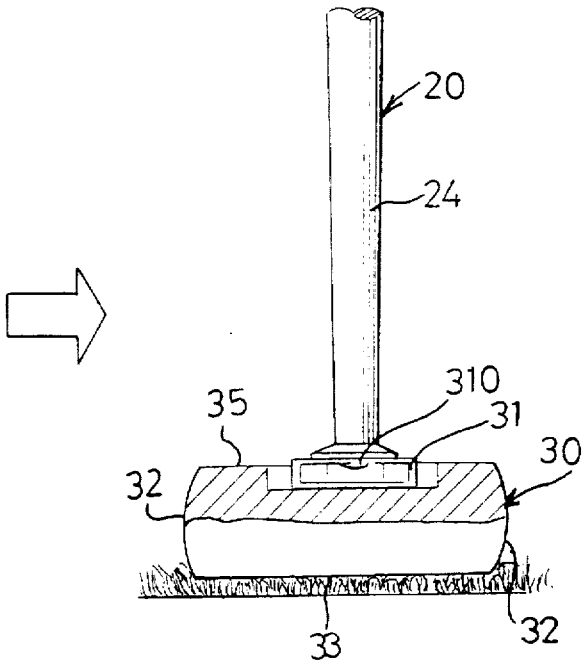
FIG. 10 is an operational view of FIG. 9.

In operation, referring now to FIGS. 9 and 10 with reference to FIG. 7, the indicating bubble 310 of one of the spirit levels 31 will deviate from the middle position thereof when the flat bottom face 33 of the head 30 is placed on an uneven patch of grass as shown in FIG. 9 which means that the head 30 is not disposed in a level state such that the ball striking surface 32 does not match the center of gravity of a golf ball, thereby easily affecting a trajectory of the golf ball when being struck.

The grass can then be flattened so as to retain the flat bottom face 33 of the head 30 in a level state as shown in FIG. 10 such that the indicating bubble 310 can be returned to the middle position thereof and such that the ball striking surface 32 matches the center of gravity of the golf ball, thereby correcting the trajectory of the golf ball precisely.

Figure 11:
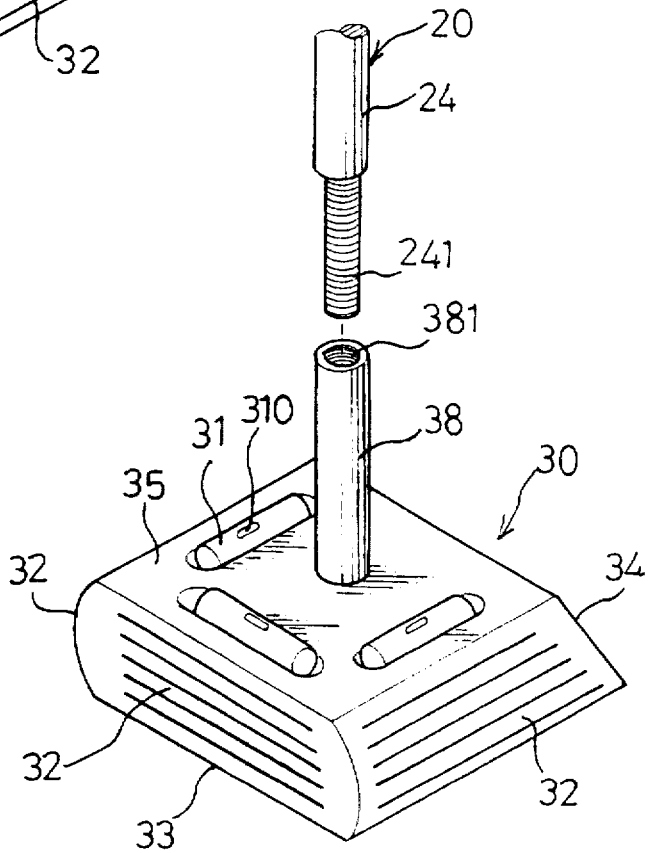
FIG. 11 is a partially cut-away exploded view of a golf club structure in accordance with a third embodiment of the present invention.

Referring now to FIG. 11, in accordance with a third embodiment of the present invention, the top face 35 of the head 30 is formed with a tube 38 protruding upwardly and defining a screw hole 381 therein, and the second end portion 24 of the shaft 20 is formed with a threaded rod 241 threadedly engaged in the screw hole 381.

It should be clear to those skilled in the art that further embodiments may be made without departing from the scope and spirit of the present invention.

What is claimed is:

1. A golf club structure comprising:

a shaft including a first end portion and a second end portion an alignment apparatus including a prism pivotally mounted on said first end portion of said shaft, and a first alignment line formed on said prism; and a head fixedly mounted on said second end portion of said shaft and including a top face and a bottom face, and a second alignment line formed on said top face of said head and aligning with said first alignment line.

2. The golf club structure in accordance with claim 1, wherein said first end portion of said shaft defines a recess by two lugs each defining a hole communicating with said recess, said prism is received in said recess and includes two sides each defining a depression aligning with said hole of a corresponding one of said two lugs, and said alignment apparatus further comprises two retaining pins each extending through said hole of a corresponding one of said two lugs and partially received in said depression of a corresponding one of said two sides of said prism such that said prism can be pivoted in said recess.

3. The golf club structure in accordance with claim 2, wherein said alignment apparatus further comprises a protective hood removably mounted on an outer periphery of said first end portion of said shaft for encompassing said prism.

* * * * *